United States Patent [19]

Fromer

[11] 4,428,339

[45] Jan. 31, 1984

[54] ROTARY ENGINE

[76] Inventor: Shmuel Fromer, 10 Reiness St., Kiryat-Shmuel, Haifa, Israel

[21] Appl. No.: 308,515

[22] Filed: Oct. 5, 1981

[51] Int. Cl.[3] ..... F02B 53/00

[52] U.S. Cl. ..... 123/245; 418/226

[58] Field of Search ..... 123/241, 245, 247; 418/226

[56] References Cited

U.S. PATENT DOCUMENTS

| | | | |
|---|---|---|---|
| 3,521,979 | 7/1970 | Horst | 418/226 |
| 3,867,075 | 2/1975 | Horst | 418/226 |
| 4,055,156 | 10/1977 | Salgueizo | 123/229 |
| 4,249,492 | 2/1981 | Norris | 418/226 |

*Primary Examiner*—William R. Cline
*Assistant Examiner*—John M. Kramer
*Attorney, Agent, or Firm*—Norbert P. Holler

[57] ABSTRACT

A rotary engine includes a housing defining an annular space in which two block-like pistons, each having a first side, are arranged for orbiting movement in opposite directions and so as to come into a face-to-face engaging state across the width of the annular space, with their first sides directed toward each other, at each of two opposite locations in the housing. At least one of the pistons has a concavity at its first side so that when the pistons are in their face-to-face engaging state, a sealed chamber is defined between them. An arrangement of pins connected with the pistons and riding in grooves provided in the housing enables the pistons to rotate as a unit about an axis of the unit by 180° in one sense while engaged at either of the said locations and then to pivot individually by 180° in the opposite sense after separating and preparatory to approaching each other for engagement at the other location. The pistons are connected with a transmission for power take-off from or input to the engine. This abstract is not to be taken either as a complete exposition or as a limitation of the present invention, however, the full nature and extent of the invention being discernible only by reference to and from the entire disclosure.

15 Claims, 25 Drawing Figures

ROTARY ENGINE

This invention relates to rotary engines adapted to operate either as power engines, such as internal-combustion engines wherein energy is converted into useful mechanical power, or as work engines, such as compressors or pumps, wherein mechanical power is converted into potential energy such as of compressed gas.

According to the invention there is provided a rotary power/work engine comprising a circular fixed housing defining an annular space, two block-like pistons disposed within said housing and having respective first sides, the pistons being arranged for orbital movement in opposite directions within the annular space and so as to sequentially and at each of two opposite locations in the housing come into and separate out of a face-to-face engaging state in which their first sides face each other, at least one of the pistons having a concavity at its first side so that a sealed chamber is defined between the pistons when they are in the face-to-face engaging state thereof, means for effecting at each of the two locations a first rotational movement of the pistons as a unit about an axis of the unit by 180° in one sense while they are in their face-to-face engaging state, means for effecting a second rotational movement of each of the pistons individually by 180° in a sense opposite to the first sense upon separation of the pistons after completion of their joint first rotational movement, power/work transmitting means located externally of the housing, and means for coupling each piston to the power/work transmitting means.

According to a preferred embodiment of the invention, the said annular space has a prismatic, i.e. generally square or rectangular, cross-section. The housing includes three fixed walls defining three sides of the space, and the fourth side of the space is defined by a pair of side-by-side rings located in the open region between two of the walls and each coupled to one of the pistons, the rings being connected with the said power/-work transmitting means which in turn comprise a gear crown mounted on each of the rings and a common gear wheel meshing with the gears crowns.

Preferably the rings are coupled to their respective pistons by pin-and-slot arrangements, comprising pins fixed to the rings and slots formed in the pistons, and the means for effecting the various rotational movements of the pistons comprise pins fixed to the pistons and projecting into guide slots formed in a wall of the housing opposite the wall constituted by the rings.

If the engine according to the invention is intended to operate as a two-stroke internal combustion engine, means would be provided at each of the two opposite locations in the housing for introducing a fuel (e.g. a gasoline and air mixture) into the annular space between the pistons when the same are approaching each other, and further means would be provided at each of the two opposite locations in the housing for igniting the gas in the sealed chamber there defined between the engaged pistons after they have substantially completed their joint rotational movement and for evacuating exhaust gases from the annular space after the disengagement of the pistons.

These and further features and advantages of the invention will become apparent from the following description of a preferred embodiment of the invention, given by way of example only, with reference to the enclosed drawings, wherein FIG. 1 is a fragmentary partly cross-sectional, generally schematic illustration, in perspective, of the basic constructional and design features of the engine according to the invention;

Figure 23:
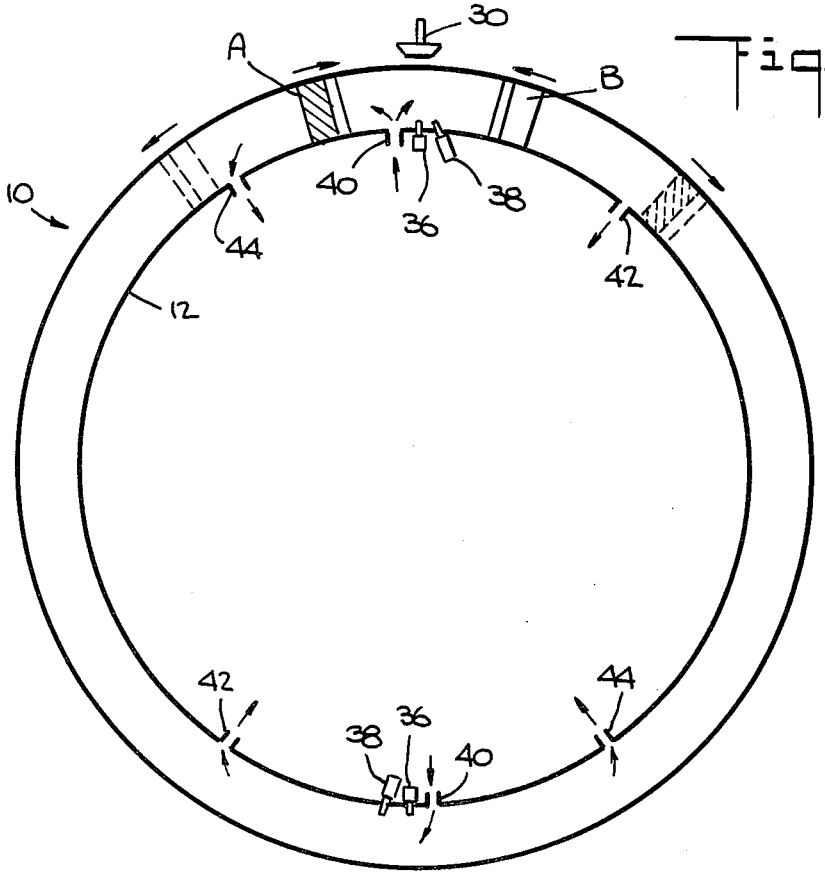

FIGS. 4 to 14 are fragmentary diagrammatic illustrations of the pistons at various stages during one cycle of operation, starting with their face-to-face engaging state at one of the two opposite working locations in the housing, continuing with their joint rotation and subsequent separation and individual rotations, and concluding with their approaching each other at the other of the two locations, the guide slots being omitted from FIGS. 4 to 13 for the sake of simplicity;

FIGS. 15 to 22 show schematically the full engine housing and various operational stages of the pistons therein; and FIG. 23 is a schematic diagram of the engine according to the invention and shows it as provided with means for enabling it to operate as a two-stroke internal combustion engine.

Figure 1:
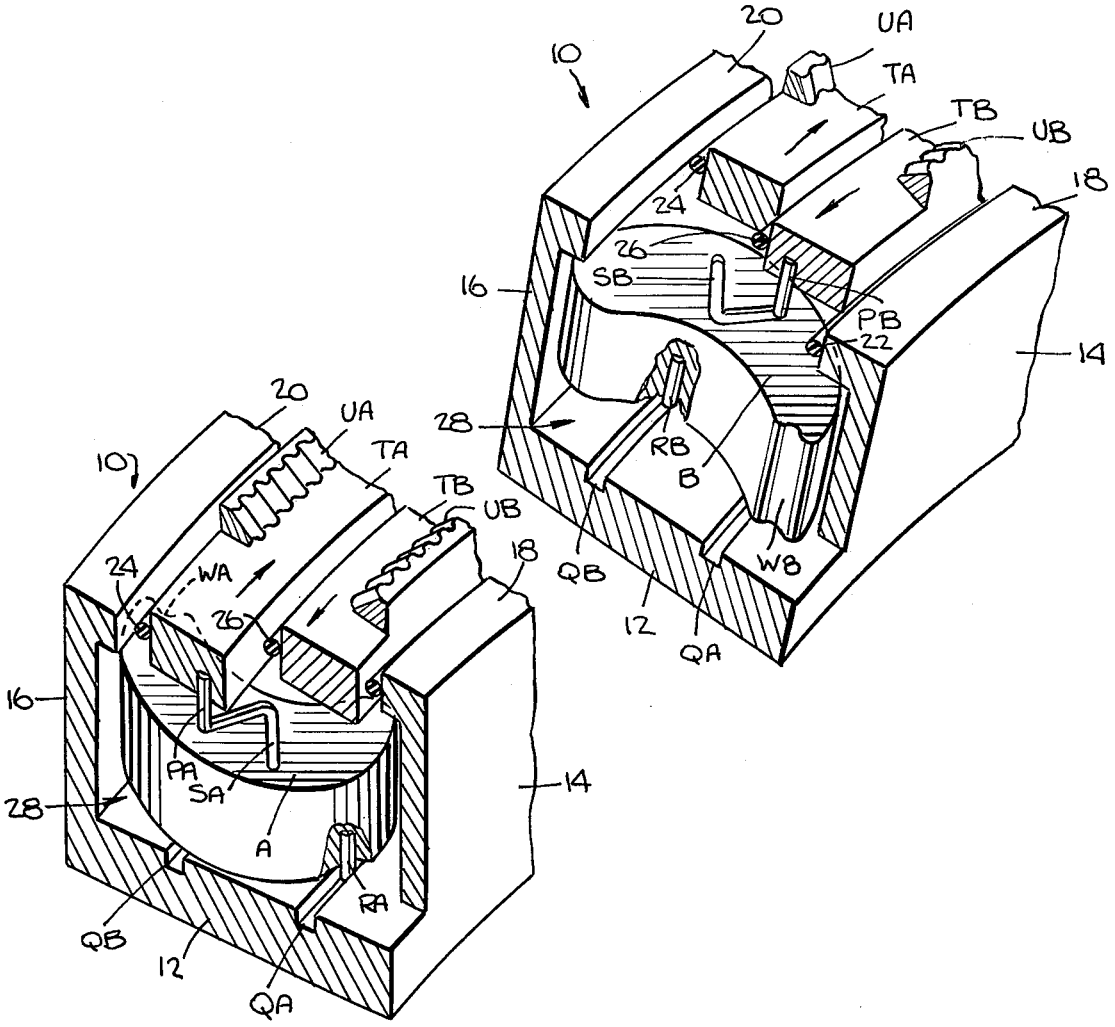

Generally, as shown in FIG. 1, the engine according to the present invention consists of a circular hollow housing 10 (see also FIG. 23) having a substantially square or rectangular U-shaped cross-section and having a bottom wall 12, side walls 14 and 16, and partly inwardly directed upper walls 18 and 20. The remaining portion of the upper wall of the housing is constituted by a pair of rings TA and TB which are located side-by-side and are freely rotatable about the axis of the housing 10. The rings are sealed against their adjacent walls 18 and 20, and against each other, by sealing rings or like packing means 22, 24 and 26. Thus, a sealed hollow annular space 28 of prismatic, i.e. square or rectangular cross-section, is formed.

Figure 2:
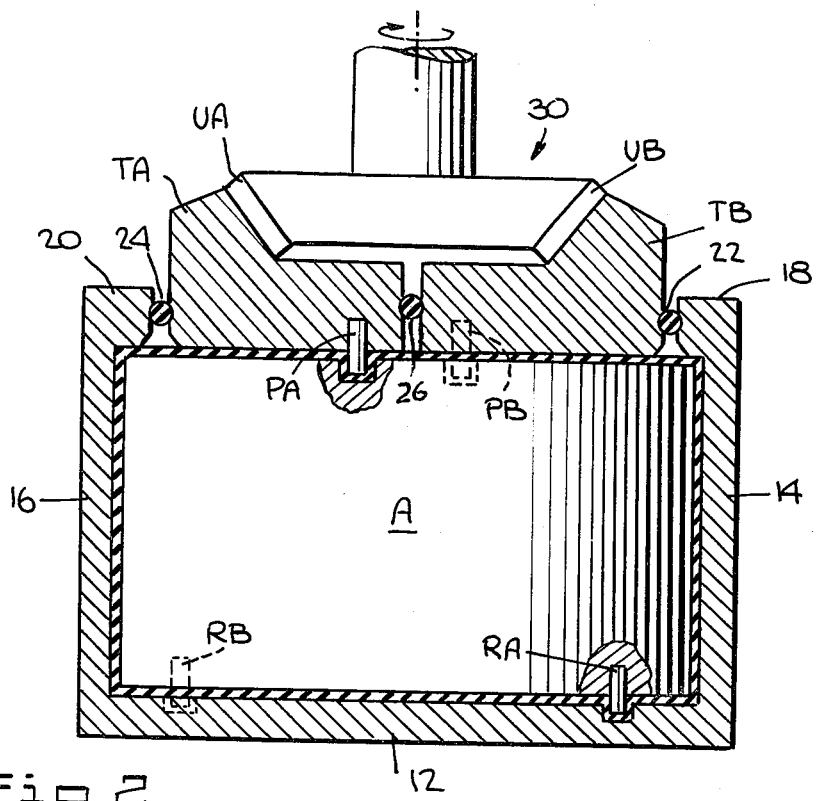
FIG. 2 is a diagrammatic cross-sectional view of the engine including the external power/work transmitting means.
Figure 3:
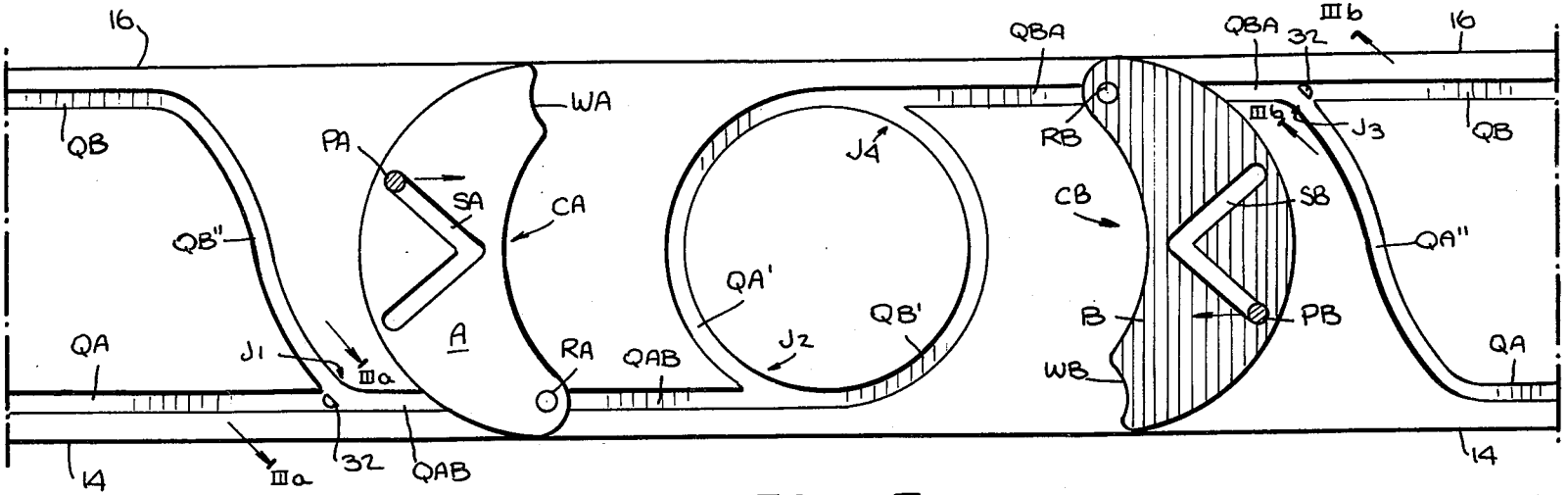
FIG. 3 is a graphic, expanded representation of the two pistons and associated guide pin-and-slot and driving pin-and-slot arrangements of the engine in a stage just before the pistons reach their face-to-face engaging state.

Located within the housing 10 are two profiled block-like members, constituting pistons A and B, which are arranged to orbit in opposite directions through the annular space 28. Each of the pistons A and B is "banana" shaped in cross-section as viewed from above, forming on a first side of each piston a concavity CA and CB (see also FIG. 3), and each piston is square or rectangular in cross-section as viewed from its first side (see also FIG. 2). The pistons are adapted to fit snugly into the space 28 and act to completely seal such space from one side to the other when they approach their face-to-face position as shown in FIG. 3, (the compression phase—see below). To this end, each piston (see FIG. 2) has on its upper and lower flat surfaces facing the rings TA and TB and the housing bottom wall 12, and on its extreme arcuate end surfaces facing the housing side walls 14 and 16, a suitable sealing means such as flexible vane-type strips, as shown in heavy cross-hatched outline in FIG. 2, to assure such slidingly sealing of the pistons, including their guiding and driving slots and pins. The pistons A and B further have depressions WA and WB at one end of each of their first sides which are provided for a purpose to be explained more fully hereinafter.

Considered with reference to the entire housing, the guide slots, which are formed on the inside surface of the bottom wall 12, include a pair of circular loops each at a respective one of the two opposite working locations, two pairs of parallel, first and second slots extending peripherally of the annular space 28 in the intervals between the circular loops, and two traversing slots arranged on opposite sides of each of the circular loops. The second slot of each pair merges at one end thereof tangentially into a respective one of the circular loops and has its other end terminating short of the other circular loops, and correspondingly the first slot of each pair merges at one of its ends, i.e. the one which is proximate to the non-merging end of the second slot of the same pair, tangentially into the said other circular loop and has its other end terminating short of the said one circular loop. Each of the traversing slots interconnects the non-merging end of the respective first or second slot with the end region of the merging second or first slot of the same pair. Finally, a one-way gating means is provided at the juncture between each traversing slot and the merging first or second slot. All of these features will be more fully identified as the description proceeds.

Referring now further to FIGS. 1 and 3, the piston A as there shown is provided with a downwardly projecting guide pin RA which is fixed to the piston and projects smoothly slidably into the first guide slot QA of one of the two pairs of guide slots QA and QB. The upper surface of the piston A is provided with a V-shaped (or arcuate) slot SA forming a track for a pin PA that is fixed to the ring TA and projects smoothly slidably into the slot SA to couple the ring TA to the piston A. Similarly, a pin RB is fixed to the bottom of the piston B and is slidable within the second guide slot QB of the other pair of guide slots, while a pin PB couples the piston B to the ring TB through a V-shaped (or arcuate) slot SB in which it is slidably received. It should be noted that the directions of the two piston-driving slots SA and SB are opposite to the concavities CA and CB of their respective pistons A and B, i.e. that these slots are concave in directions away from the first sides of the respective pistons.

Finally, each ring TA and TB is provided with a crown of bevel gear teeth UA and UB adapted to mesh with a single or common gear-wheel 30 (FIG. 2), such gearing constituting the power/work output/input transmitting means of the engine.

The specific layout of the guide slots will best be understood from a consideration of FIG. 3, starting from the left-hand side thereof. As there shown, the paired guide slots QA and QB extend peripherally of the space 28 and parallel to each other as well as to the walls 14 and 16 of the housing 10 for guiding the piston A by the pin RA. The slot QA passes first a junction J1, the function of which will be described further below, and continues to run parallel to the wall 14 until it reaches a junction J2, the section of the slot between the two junctions being designated QAB. At the junction J2 the slot QAB is branched off into two slots QA′ and QB′ which together complete a circular loop. The slot QB terminates short of the circular loop, and at the junction J1 the slot QA branches-off into a traversing slot QB″ which leads back to the proximate end of the slot QB.

In a symmetrical manner, at the other side of the circular loop QA′/QB′ the slot QB merges tangentially with the circular loop via a straight slot section QBA extending past a junction J3 and to a junction J4, while the slot QA terminates short of the loop. A second traversing slot QA″ leads from the junction J3 back to the proximate end of the guide slot QA.

Figure 3B:
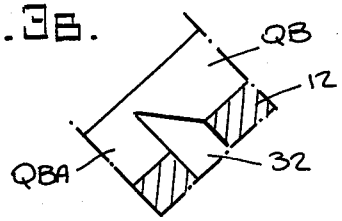
FIGS. 3A and 3B are, respectively, cross-sectional views taken along the lines IIIa—IIIa and IIIb—IIIb in FIG. 3.
Figure 3A:
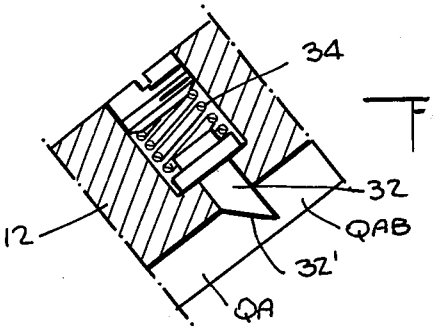

At the junction J1 the slot QA is provided with a unidirectional gating means, for example a device of the depressable pin type shown in FIG. 3A. This device comprises a spring-loaded pin or detent 32 movable between an extended position where it projects into the slot QA under the force of a spring 34, and a retracted position where it withdraws into its cavity when pressed on its tapered surface 32′. It will be apparent, therefore, that the pin RA, as the same passes from the slot QA into the slot extension QAB upon approaching the junction J1 from the left-hand side will pass over the gating detent 32, but that a similar guide pin coming from the right-hand direction along the slot section QAB will be diverted by the detent 32 into the traversing slot QB″.

Similarly, an identical gating means 32 is provided at the junction J3 (see also FIG. 3B). This arrangement will allow the continuing movement of the pin RB from the slot QB into the slot extension QBA, but will block the way back into slot QB from the left and will direct the movement of a pin approaching along the slot section QBA into the traversing slot QA″.

Figure 14:
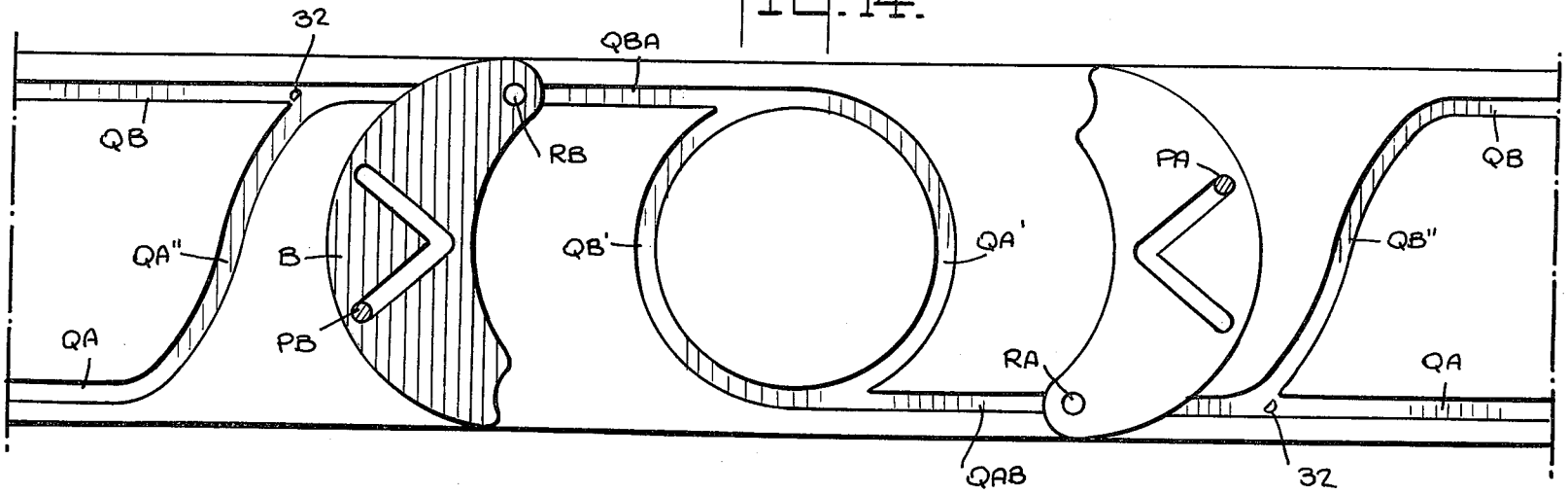

A similar, but inverted or mirror-image of this layout and arrangement of the guide slots is provided at the diametrically opposite side of the housing 10 (see FIG. 14).

In operation, it is assumed, as a starting point, that the rings TA and TB rotate in respective directions as shown by the arrows in FIG. 1. Pistons A and B extend transversely across the annular space 28 and are slidably supported at all four sides thereof, as well as guided by pins RA and RB running in their respective parallel slots QA and QB, thus assuring that each piston maintains its "parallel-to-itself" orientation while orbiting translationally through the space 28 under the propulsion of the driving pins PA and PB fixed to the rings TA and TB and projecting into the slots SA and SB. Upon reaching the junctions J1 and J3, the pins RA and RB pass uninterruptedly over the gating detents 32, and continue along the guide slot extensions QAB and QBA until they reach the face-to-face engaging position schematically shown in FIG. 4, where actually the two pistons collide and become a cross-sectionally circular unit by virtue of the interfitting of the depressions WA and WB at one end of each of the pistons with the respectively opposed protruding noses at the other ends of the pistons. At this instant, a sealed chamber CH is formed between the pistons A and B. It will be noted that in this position of the pistons, the pin RA is located at the junction J2 and pin RB is located at the junction J4.

Figure 4:
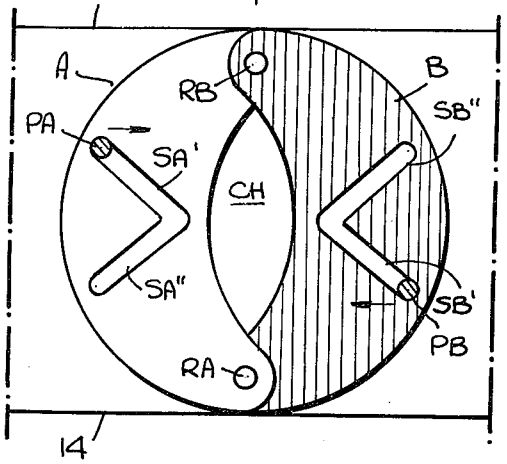
Figure 5:
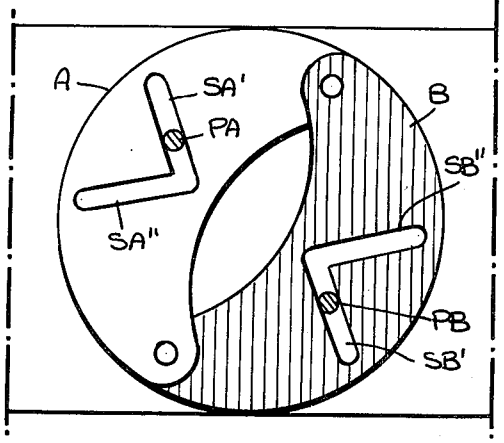
Figure 6:
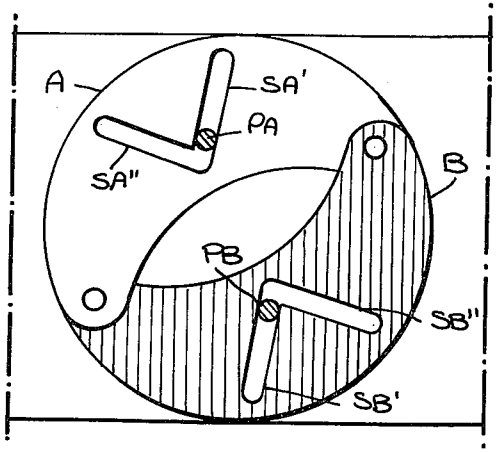
Figure 7:
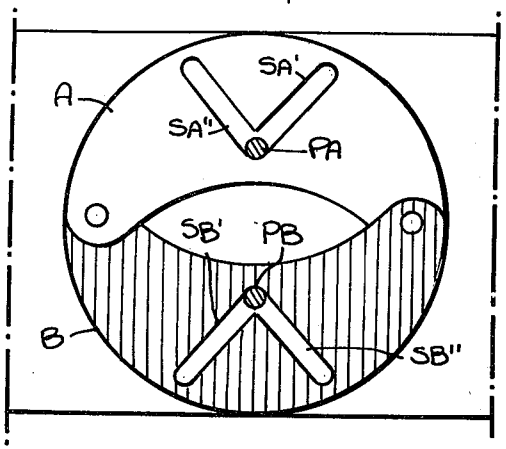

Further rotation of the rings TA and TB, which never stops, then causes, due to the unsymmetrical or off-center locations of the driving pins PA and PB, a joint rotational movement of the pistons A and B as a unit about the composite axis while the same are in their face-to-face engaging state, i.e. as if they were one solid body, in the clockwise direction as seen in FIG. 5. This movement is facilitated due to the fact that at the first, colliding position (FIG. 4) the guide pin RA is located at the junction J2 and the guide pin RB is located at junction J4, so that the pins can enter the semicircular guide slots QA′ and QB′, respectively. On the other hand, the continuing movement of the driving pins PA and PB is not interrupted due to their relative free movement within the first-engaged branches SA' and SB' of the slots SA and SB of the pistons, and this movement, as shown in FIGS. 5, 6 and 7, continuous until each piston has completed a 90° rotation.

Figure 8:
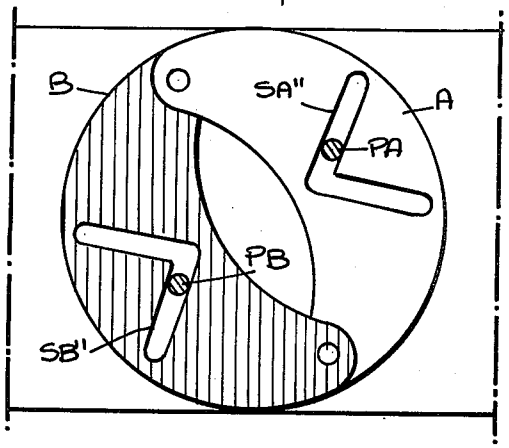
Figure 9:
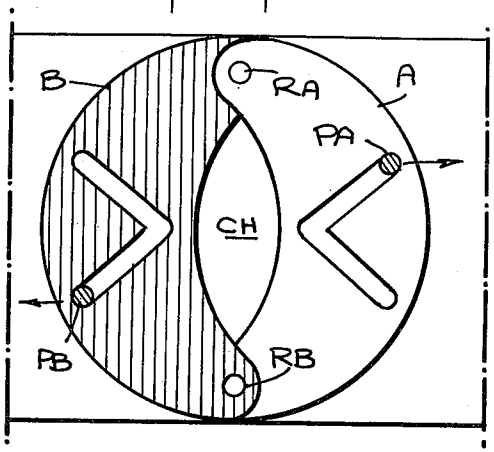
Figure 10:
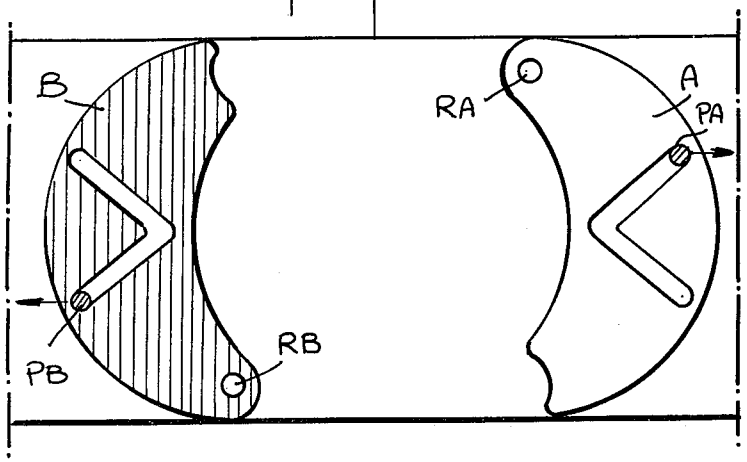

When the pins PA and PB reach the apexes or reversal (dead center) points of their associated slots SA and SB, the inertia of the spinning pistons, gained during their accelerated joint rotational movement generated by the driving pins sliding along the relatively steeply sloping surfaces of the branches SA', SB' of the slots SA and SB, forces the pins PA and PB past those apexes and thus to enter the branches SA" and SB"; thus, the pins do not re-enter the branches SA' and SB' which would simply bring the pistons back to their initial position of FIG. 4. However, if necessary, the pins PA and PB may be provided with changeover catching means that will assure the continuing progress of the pins from one slot branch to the other beyond the above-described dead-center positions. The combined rotation of the pistons then continues through another 90°, as shown in FIGS. 8 and 9, until an opposite, 180° rotated position of the pistons is attained. At this stage, the guide pin RA reaches the junction J4 and the pin RB reaches the junction J2, so that as the pistons start to separate the pin RA enters the section QBA of the opposite slot QB while the guide pin RB enters the section QAB of the opposite slot QA. During further movement of the rings TA and TB, therefore, the pistons initially maintain their face-to-face orientation while continuing to move away from each other, as shown in FIG. 10. (As previously mentioned, in FIGS. 4 to 10, as well as in the following FIGS. 11, 12 and 13 still to be discussed, the guide slots have been omitted for the sake of clarity and simplicity.)

Figure 11:
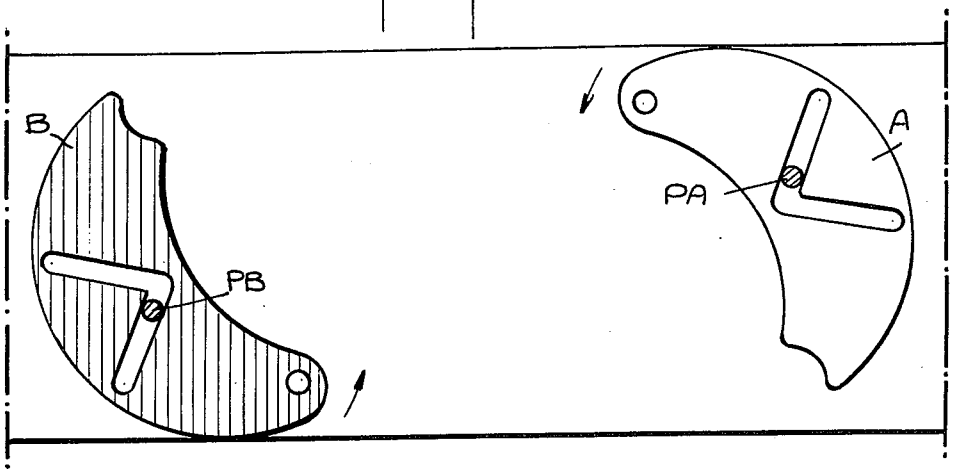
Figure 12:
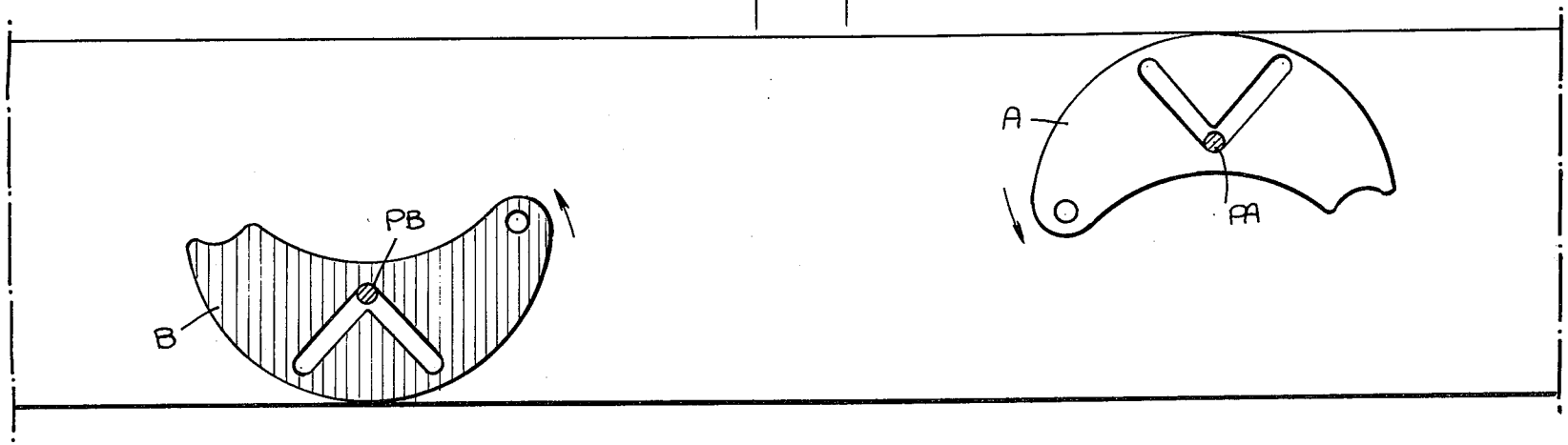
Figure 13:
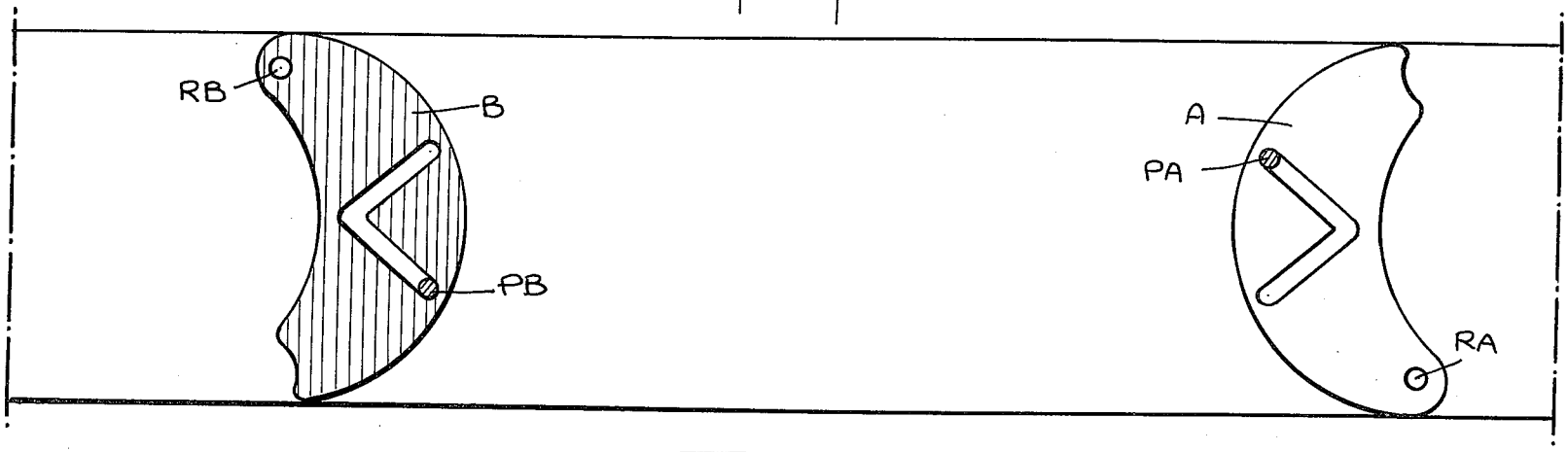

When the pin RA reaches the junction J3, the gating detent 32 there located prevents further straight movement of the pin and rather diverts the same into the connecting or traversing slot QA", and similarly the guide pin RB upon reaching the junction J1 is diverted into the traversing slot QB". This detouring of the guide pins causes their respective pistons A and B to individually rotate in a sense opposite to that of their joint rotation, i.e. in the counterclockwise direction as seen in FIGS. 11 and 12, until the pins RA and RB, respectively, enter the ends of the slots QA and QB which ended short of the circular loop QA'/QB'. The pistons are then again in respective positions bridging the space 28 but now in a back-to-back relation, as shown in FIG. 13. The pistons have, in fact, changed places and are moving away from each other, each toward the circular loop at the opposite location in the housing 10.

Figure 15:
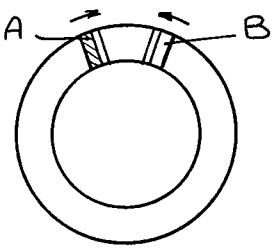
Figure 16:
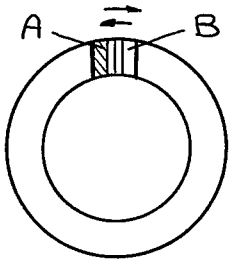
Figure 17:
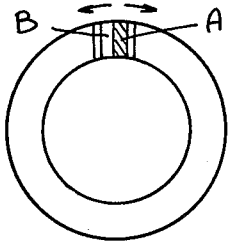
Figure 18:
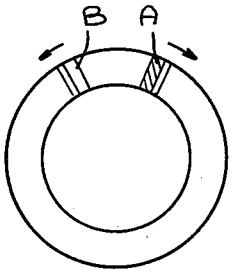
Figure 19:
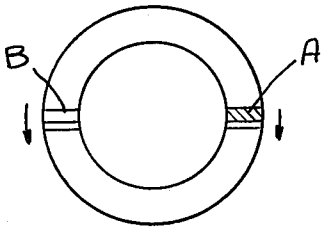
Figure 20:
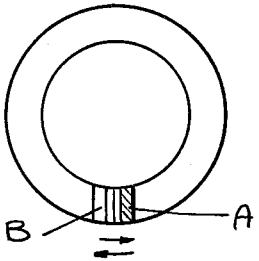

The kinematics of the pistons as so far described is schematically represented in FIGS. 15 through 22, wherein FIG. 15 corresponds to the position shown in FIG. 3, FIGS. 16 and 17 correspond to FIGS. 4 and 9, and FIG. 18 corresponds to FIGS. 10 to 13. Thereafter, since the pistons A and B now approach each other at the opposite section of the circular housing, the above-mentioned relative back-to-back position of FIG. 13 becomes a face-to-face position at the geometrically opposite location of the pistons, as shown in FIGS. 19 and 20, except that the piston B now approaches the colliding position from the left, and the piston A from the right, to reach the state shown in FIG. 14 where the first sides of the two pistons are again directed towards each other.

Figure 21:
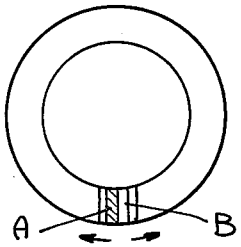
Figure 22:
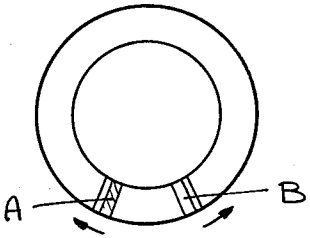

Since a layout of guide slots identical to that shown in FIG. 3 is provided at the diametrically opposite section of the housing 10 (see FIG. 14), the same process of face-to-face engaging, followed by rotation of the pistons as a unit, followed by the separation and individual reverse rotation of the pistons, occurs there as well, as shown in FIGS. 21 and 22, and the pistons then continue from the position shown in FIG. 22 back into the one shown in FIG. 3 (or FIG. 15), thus completing a full cycle of operation.

The utilization of the engine according to the present invention as a gasoline internal combustion rotary engine will now be described with reference to FIG. 23. For this purpose, spark plugs 36 are provided at the bottom wall 12, at the two locations corresponding to the face-to-face engaging positions of the pistons A and B. Fuel, e.g. an air and gasoline mixture, is supplied through suitable devices 38 and 40, including means for effecting a forced air circulation. Exhaust gases leave through ports 42 and 44.

To start the combustion cycle (which is comparable to the conventional two-stroke cycle of reciprocating piston engines), the rings TA and TB are set into rotation, as by an initial driving of the bevel gear 30. This forced rotation of the rings TA and TB first causes the approaching, abutting and commencement of the joint rotation of the pistons A and B. The combustion and explosion of the compressed gasified fuel mixture within the sealed chamber CH (FIG. 9) then ensures that the rings continue to rotate in the same initial direction under the action of the pistons A and B through the pins PA and PB. The inertia of the orbiting pistons and rotating rings (acting, in fact, also as flywheels) thereafter causes the same cycle to repeat itself at the opposite side of the housing 10, and the engine thus will run as long as fuel is supplied thereto and the timing of ignition and exhaust is properly maintained.

For use of the engine as a work machine, such as a compressor or pump, power will be supplied to the engine by rotation of the rings TA, TB via the bevel gear 30, uncompressed fluid will be introduced into the region of the space 28 between the approaching pistons A and B, and compressed fluid will be discharged from the sealed chamber CH at the proper stage of operation.

Having thus decribed the invention with particular reference to the preferred form thereof, it will be obvious to those skilled in the art to which the invention pertains that various changes and modifications may be made therein without departing from the spirit and scope of the invention as defined by the claims appended hereto. Merely by way of example, the rings TA and TB may be located internally instead of externally; the pistons A and B need not both be provided with a concavity CA or CB; and in order to improve the stability of the running pistons under the off-center located driving pins PA and PB, one or more additional guide pins may be provided (with respective associated guide slots) in addition to the pins RA and RB.

What is claimed is:

1. A rotary power/work engine, comprising a circular housing defining an annular space therein, two block-like pistons disposed within said housing and having respective first sides, said pistons being arranged for orbital movement in opposite directions within said space and so as to sequentially and at each of two opposite locations in said housing come into and separate out of a face-to-face engaging state in which said first sides face each other, at least one of said pistons having a concavity at said first side thereof so that a sealed chamber is defined between said pistons when the same are in said face-to-face engaging state thereof, means for effecting at each of said locations a first rotational movement of said pistons as a unit about an axis of the unit by 180° in one sense while said pistons are in said face-to-face engaging state, means for effecting a second rotational movement of each of said pistons individually by 180° in a sense opposite to said one sense upon separation of said pistons after completion of said first rotational movement, power/work transmitting means located externally of said housing, and means for coupling each piston to said power/work transmitting means.

2. An engine as claimed in claim 1, wherein said housing comprises three fixed walls and a movable fourth wall in a cross-sectionally right-angle arrangement defining said annular space and imparting thereto a prismatic cross-sectional shape, a pair of rotationally movable concentric rings constitute said fourth wall, and said rings are coupled each to a respective one of said pistons and to said power/work transmitting means.

3. An engine as claimed in claim 2, wherein said power/work transmitting means comprise a pair of gear crowns each mounted on a respective one of said rings, and a common gear wheel meshing with both said gear crowns.

4. An engine as claimed in claim 2 or 3, wherein each of said rings is coupled to the respective one of said pistons by a pin-and-slot arrangement.

5. An engine as claimed in claim 4, wherein each of said pin-and-slot arrangements comprises a pin secured to one of said rings and slidably projecting into a slot formed in the associated one of said pistons.

6. An engine as claimed in claim 5, wherein each of said slots has a generally concave configuration with the concavity directed away from said first side of the respective piston.

7. An engine as claimed in claim 1, wherein said means for effecting said first and second rotational movements of said pistons comprise respective pins secured to said pistons and slidably projecting into associated guide slots formed in a wall of said housing opposite the location where said pistons are coupled to said power/work transmitting means.

8. An engine as claimed in claim 7, wherein said housing comprises three fixed walls and a movable fourth wall in a cross-sectionally right-angle arrangement defining said annular space and imparting thereto a prismatic cross-sectional shape, a pair of rotationally movable concentric rings constitute said fourth wall, and said rings are coupled each to a respective one of said pistons and to said power/work transmitting means.

9. An engine as claimed in claim 8, wherein said power/work transmitting means comprise a pair of gear crowns each mounted on a respective one of said rings, and a common gear wheel meshing with both said gear crowns.

10. An engine as claimed in claim 7 or 8, wherein each of said rings is coupled to the respective one of said pistons by a pin-and-slot arrangement.

11. An engine as claimed in claim 10, wherein each of said pin-and-slot arrangements comprises a pin secured to one of said rings and slidably projecting into a slot formed in the associated one of said pistons.

12. An engine as claimed in claim 11, wherein each of said slots has a generally concave configuration with the concavity directed away from said first side of the respective piston.

13. An engine as claimed in claim 7, wherein said guide slots include a pair of circular loops each at a respective one of said two opposite locations for effecting said first rotational movement of said pistons, two pairs of parallel, first and second slots extending peripherally of said annular space in the intervals between said circular loops for effecting said orbital movement of said pistons, and two traversing slots arranged on circumferentially opposite sides of each of said circular loops for effecting said second rotational movements of said pistons, said second slot of each pair merging at one end thereof tangentially into a respective one of said circular loops and having its other end terminating short of the other circular loop, said first slot of each pair merging at one end thereof, which is proximate to the non-merging end of said second slot of the same pair, tangentially into said other circular loop and having its other end terminating short of said one circular loop, and each of said traversing slots interconnecting the non-merging end of the respective first or second slot with the end region of the merging second or first slot of the same pair.

14. An engine as claimed in claim 13, wherein a one-way gating means is provided at the juncture between each traversing slot and the merging first or second slot for directing said pins, during the separation of said pistons, into said traversing slots only, thereby to ensure the commencement of said individual second rotational movements by said pistons upon separation thereof.

15. An engine as claimed in any of claims 1, 2, 3, 7, 8, 9, 13 or 14, further comprising, for enabling the engine to operate as an internal-combustion power engine, means for introducing a fuel into said annular space at each of said two opposite locations so as to be confined in the region of said annular space between said first sides of said pistons when the latter are approaching each other, means at each of said two opposite locations for igniting said fuel in the respective sealed chamber defined between said first sides of said pistons when the latter are there in said face-to-face engaging state and upon substantial completion of said first rotational movement of said pistons, and means for evacuating exhaust gas from said annular space after said separation of said pistons.

* * * * *